United States Patent [19]

Makainai

[11] Patent Number: 5,076,648

[45] Date of Patent: Dec. 31, 1991

[54] COUNTER SUPPORT

[76] Inventor: Jesse K. Makainai, 99-1026 Iwaena St., Aiea, Hi. 96701

[21] Appl. No.: 430,271

[22] Filed: Nov. 2, 1989

[51] Int. Cl.[5] ..... A47B 88/00

[52] U.S. Cl. ..... 312/140.1; 248/242

[58] Field of Search ..... 312/140.1, 235; 248/242, 235

[56] References Cited

U.S. PATENT DOCUMENTS

| | | | |
|---|---|---|---|
| 3,905,572 | 9/1975 | Hikai et al. | 248/242 |
| 4,065,088 | 12/1977 | Shell | 248/242 |
| 4,253,405 | 6/1988 | Camilleri | 248/235 |
| 4,717,102 | 1/1988 | Pflieger | 312/245 X |
| 4,728,161 | 3/1988 | Murphy | 312/245 X |
| 4,753,406 | 6/1988 | Kodama et al. | 312/245 X |

*Primary Examiner*—Joseph Falk

*Attorney, Agent, or Firm*—Michael I. Kroll

[57] ABSTRACT

An improved counter support fashioned to a vertical surface such as a wall is disclosed. The improved counter support includes a wall rail having a plurality of pairs of oblong throughbores and being attached to the wall by a plurality of pairs of the oblong throughbores, respectively, the oblong throughbores being 16" and 24" on center so that the holding power of the counter support is doubled and the plurality of pairs of the oblong throughbores line up with the wall studs, a cantilever positioned anywhere along the wall rail, the cantilever being placed down onto the wall rail and being snapped into place by the hook-up so that additional adjustable flexibility is provided. When the cantilever supports the counter, a leveler disposed on the cantilever and is adjustable for leveling the cantilever, a main attachment bracket containing an oblong slot, a tab disposed on the main attachment bracket, a screw passing through the oblong slot of the main attachment bracket so that adjustment is made simpler, and an integral catch mating with the tab and forming a hook-up.

11 Claims, 3 Drawing Sheets

COUNTER SUPPORT

BACKGROUND OF THE INVENTION

1. Field of the Invention

The present invention relates to a counter support.

More particularly, the present invention relates to an improved counter support.

2. Description of the Prior Art

The U.S. patent to Schmidt teaches a strip of sheet metal which can accommodate cabinets but does not have the capacity to accommodate counter tops. The improved counter support of the present invention has the flexibility to accommodate all types of usage. Unlike the metal cabinet hanger taught by Schmidt, the present invention has an adjustment feature which firmly adjusts the levelness while compensating for flaws in the levelness of the walls and of the ground.

The U.S. patent to Kulikowski et al. teaches a support rail which is unrelated to the present invention. The present invention is designed for supporting counters, drawers, file cabinets, cabinets, and the like. The support rail of Kulikowski et al. does not have the strength and holding power of the present invention.

The U.S. patent to Kelley teaches a hanger similar to the metal cabinet hanger and does not have the strength nor the design to hold counter tops, etc., whereas the present invention accommodates both counter tops, cabinets, and more.

The U.S. patent to Rigstad teaches a utility shelf for laundry tubs that is good for its purpose but, the hardware can only be used for a shelf, as it was designed for, it cannot function as a support for counter tops, etc.

The purpose in which the U.S. patents to Schroder and Chervenak were designed and the designs themselves are very different in comparison with the present invention. The one major difference that sets the present invention apart from the rest is that the present invention is designed to support a counter top while facilitating many types of components underneath. The present invention has the strength, adjustability, and flexibility that has not been seen in other available hardware.

Numerous innovations for counter supports have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide an improved counter support that avoids the disadvantages of the prior art.

More particularly, it is an object of the present invention to provide the user with a system that is quick, easy, accurate, and strong. Since there is an adjustment component available, accuracy can be accomplished.

The improved counter support provides the user with flexibility. The user has the ability to position the drawers and cabinets anywhere along the counter that the user chooses.

The improved counter support offers the user a functional, good looking counter, having modifications available for use with a desk, work station, with a kitchen and bath, etc. Furthermore, the present invention is able to accommodate typewriters, computers, drafting boards, filing cabinets, shallow and deep drawers, knee space, and key board pull-outs, etc.

The improved counter support allows counter tops to be suspended without the use of any vertical supports.

In keeping with these objects, and with others which will become apparent hereinafter, one feature of the present invention resides, briefly stated, in a counter support fashioned to a vertical surface such as a wall, and including a wall rail having a plurality of pairs of oblong throughbores and being attached to the wall by the plurality of pairs of oblong throughbores, respectively. The oblong throughbores are 16" and 24" on center so that the holding power of the counter support is doubled and the plurality of pairs of oblong throughbores line up with the wall stud. A cantilever positioned anywhere along the wall rail, the cantilever being placed down onto the wall rail and being snapped into place by the hook-up so that additional adjustable flexibility is provided when the cantilever supports the counter. A leveler disposed on the cantilever and being adjustable for leveling the cantilever. A main attachment bracket containing an oblong slot. A tab is disposed on the main attachment bracket. A screw passes through the oblong slot of the main attachment bracket.

When the improved counter support is designed in accordance with the present invention, adjustment is made simpler, and an integral catch mates with the tab and forms a hook-up.

In accordance with another feature of the present invention, it further comprises a drawer rail bracket attached to the main adjustment bracket.

Another feature of the present invention is that it further comprises a drawer being attached to the drawer rail bracket and to the cantilever on opposing sides of the drawer so that moving the location of the drawer can readily be appreciated.

Yet another feature of the present invention is that it further comprises back-side ribbing for making the wall rail more rigid.

Still another feature of the present invention is that it further comprises a shelf formed in the wall rail for restricting the cantilever from having any forward or upward movement.

Yet still another feature of the present invention is that it further comprises a rest block *being positioned on the shelf and acting as a stopper in keeping the rest block from spinning.

Still yet another feature of the present invention is that it further comprises an apron bracket that is adjustable, in and out, for front alignment of the counter.

Another feature of the present invention is that it further comprises a front and a rear nailer plate being secured to and extending from the cantilever and being attached to the counter.

Yet another feature of the present invention is that it further comprises a counter rail securing the rear of the counter anywhere along the wall rail.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

DETAILED DESCRIPTION OF THE PREFERRED EMBODIMENT

Figure 1:
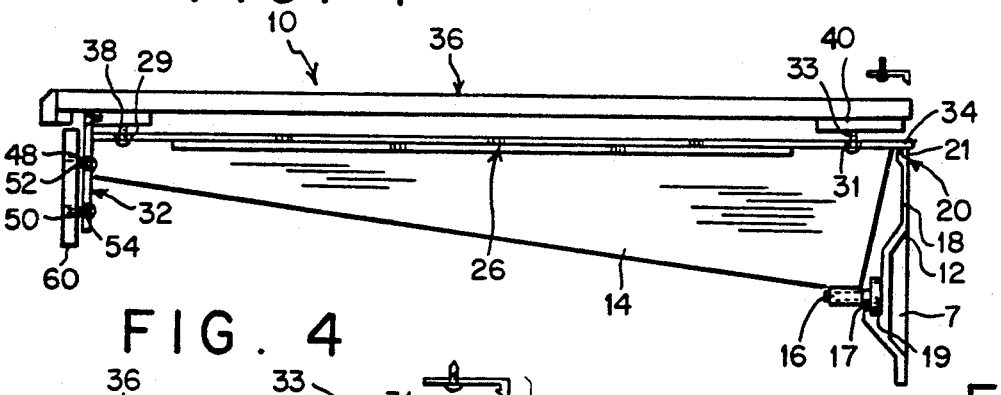
FIG. 1 is a side view of the improved counter support of the present invention.
Figure 4:
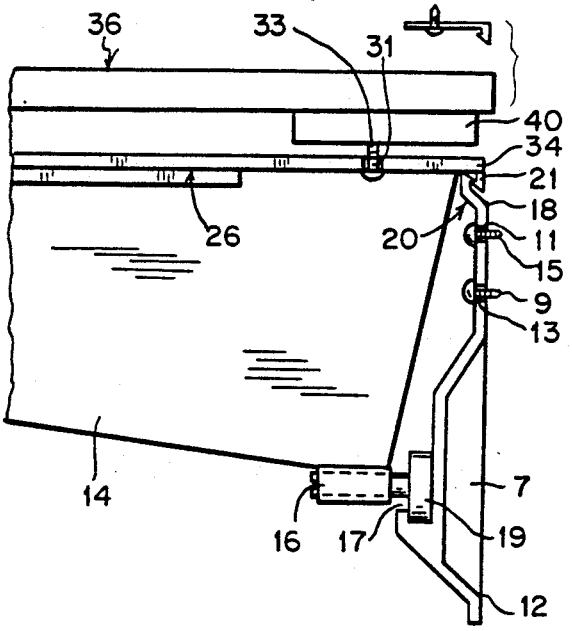
FIG. 4 is a side view of the fixed end of the improved counter support of the present invention, shown in FIG. 1.
Figure 2:
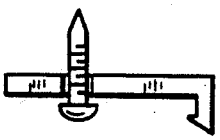
FIG. 2 is a side view of the counter rail of the improved counter support of the present invention, shown in FIG. 1.
Figure 3:
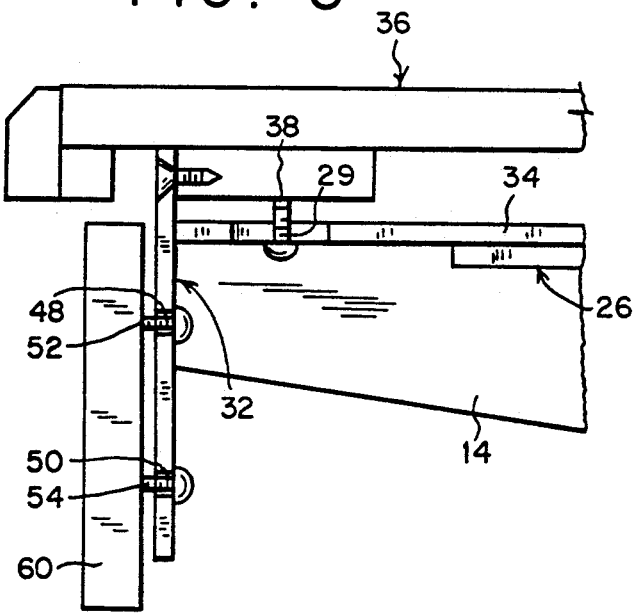
FIG. 3 is a side view of the free end of the improved counter support of the present invention, shown in FIG. 1.
Figure 5:
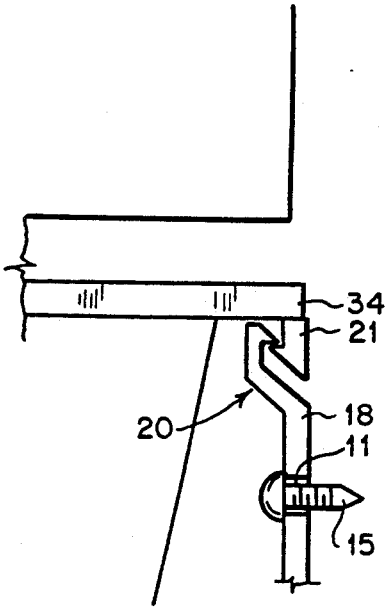
FIG. 5 is a side view of the hook-up of the improved counter support of the present invention, shown in FIG. 1.
Figure 6:
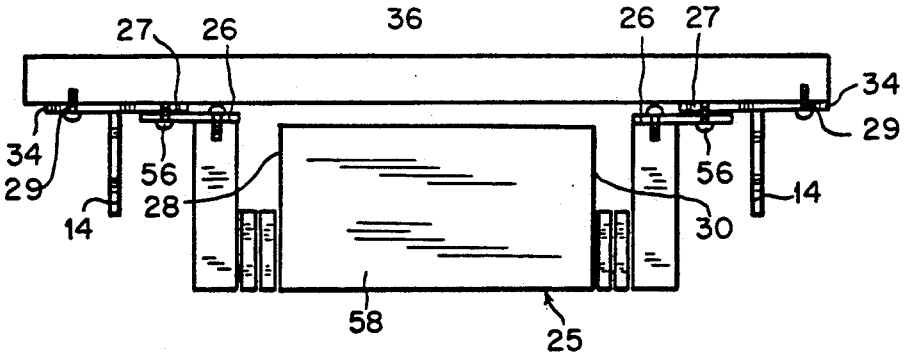
FIG. 6 is a front view of the drawer of the improved counter support of the present invention, shown in FIG. 1.
Figure 7:
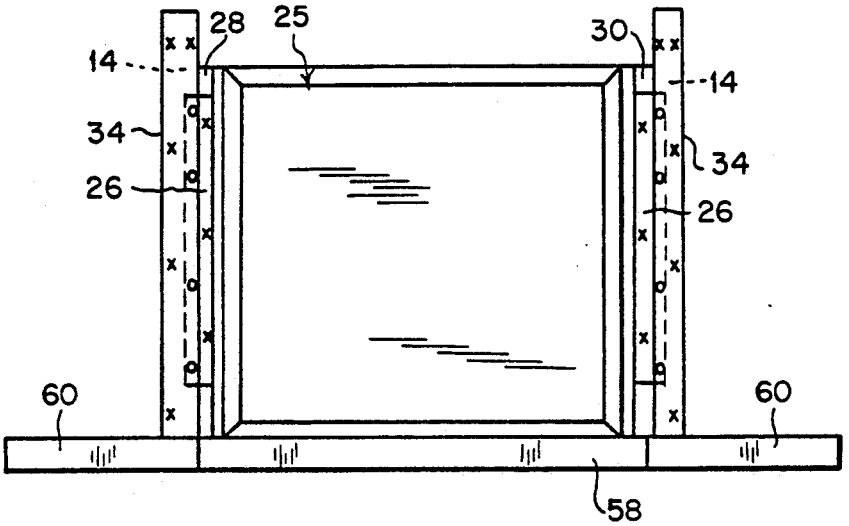
FIG. 7 is a top view of the drawer of the improved counter support of the present invention, shown in FIG. 1.
Figure 8:
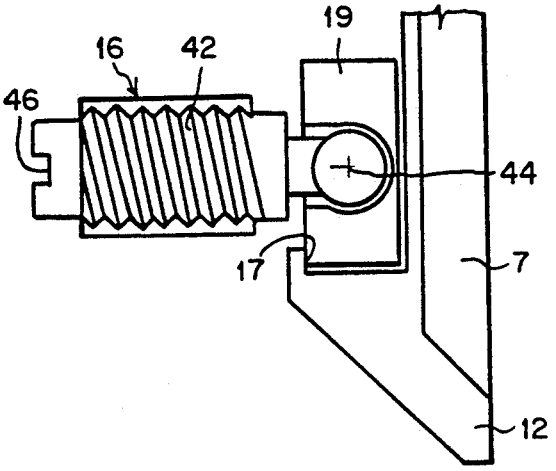
FIG. 8 is a side of the leveler of the improved counter support of the present invention, shown in FIG. 1.
Figure 10:
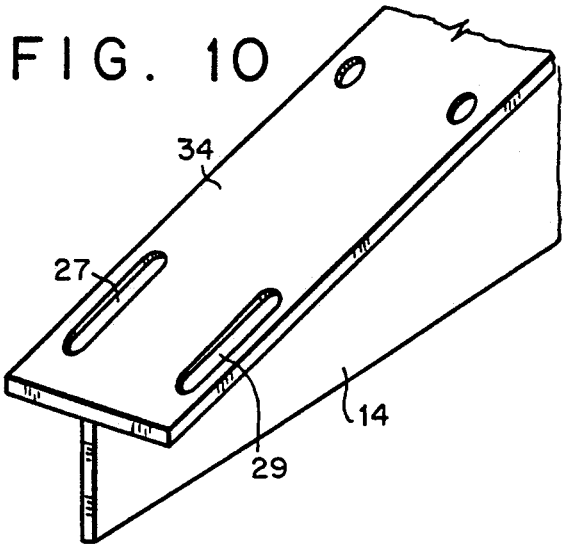
FIG. 10 is a perspective view of the main body of the cantilever of the improved counter support of the present invention, shown in FIG. 1.
Figure 9:
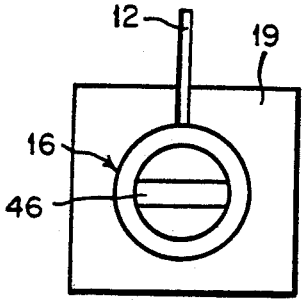
FIG. 9 is a front view of the leveler of the improved counter support of the present invention, shown in FIG. 1.
Figure 11:
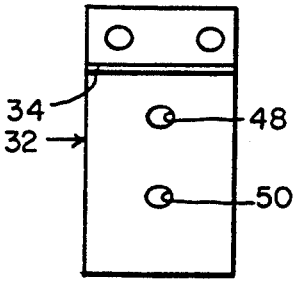
FIG. 11 is a front view of the apron bracket of the improved counter support of the present invention, shown in FIG. 1.
Figure 12:
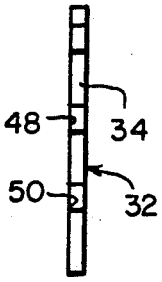
FIG. 12 is a top view of the apron bracket of the improved counter support of the present invention, shown in FIG. 1.
Figure 13:
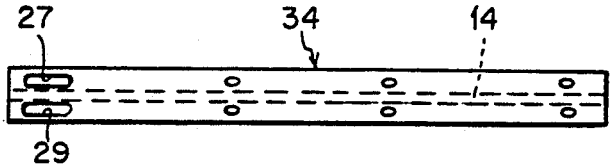
FIG. 13 is a top view of the cantilever of the improved counter support of the present invention, shown in FIG. 1.
Figure 14:
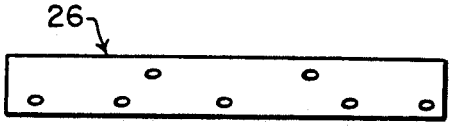
FIG. 14 is a top view of the drawer rail of the improved counter support of the present invention, shown in FIG. 1.
Figure 15:
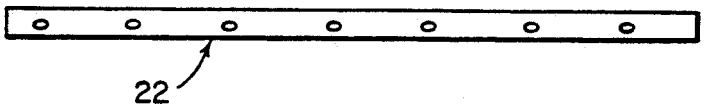
FIG. 15 is a top view of the counter rail of the improved counter support of the present invention, shown in FIG. 1.
Figure 16:
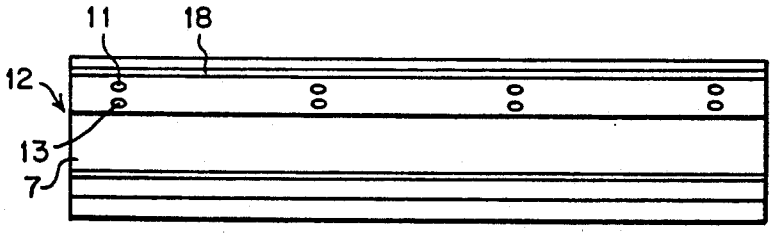
FIG. 16 is a side view of the wall rail of the improved counter support of the present invention, shown in FIG. 1.
Figure 17:
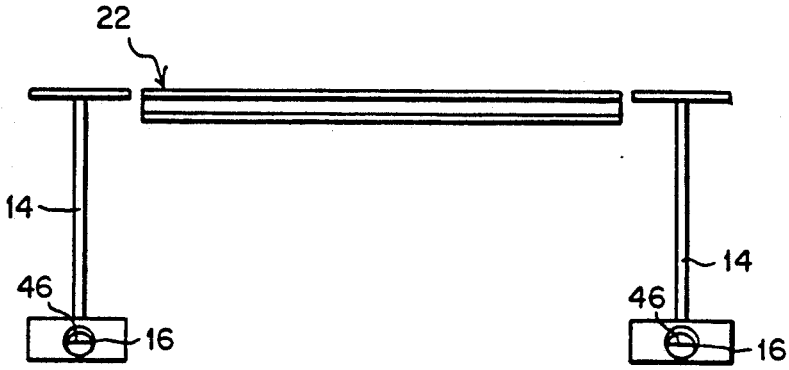
FIG. 17 is a front view of the counter rail of the improved counter support of the present invention, shown in FIG. 1.

Referring now to the figures in which like numerals indicate like parts. The wall (not shown) receives the improved counter support 10 of the present invention. The wall is properly marked with reference lines so that the installation is made simple and quick. Once the reference lines have been layed out at the desired height, the cabinet (not shown) which is to be incorporated with the lay-out is set in place. The wall rail 12 is then attached to the wall by means of a series of two screw holes 11 and 13 which are already located at 16" and 24" O.C. positions. In a stack formation, one hole 11 is directly above the other hole 13 and providing double the anchoring hold.

The back side ribbing 7 makes the wall rail 12 more rigid. A shelf 17 is created in the wall rail 12. The shelf 17 restricts the cantilever 14 from having any forward or upward movement and further receives a cubic shaped rest block 19 which acts as a stopper in keeping the rest block 19 from spinning. The wall rail 12 is cut to the respective length, and aligned with the wall studs (not shown) of any other type of wall backing. There are no limitations of the kind of wall construction which is going to be used for the improved counter support 10. It could be new, old, double wall or single wall, masonry or hollow tile, etc.

Once the wall rail 12 is mounted, the cantilever 14 is positioned anywhere along the wall rail 12 to meet the requirements. The cantilever 14 is then adjusted by a leveler 16 which is designed to level the cantilever 14, while maintaining precise means of adjustment, which is not limited to it.

The internal threads 42 and the pivot ball 44 are of one homogeneous piece machined to serve different functions. The rest block 19 has its basic shape and configuration, which is not limited to it.

A square shape is used. The pivot ball 44 acts as a pivot point making it possible to rest flat on the face of the wall rail 12, no matter what adjustment is needed.

The leveler 16 features unlimited adjustments in the forward direction to provide proper function.

The apron bracket 32 mounts to the front of the nailer plate 40 so that the apron 32 can be attached to the lower part of the bracket.

The cantilever 14 attaches to the wall rail 12 by way of a tab 21 on the main attachment bracket 34 and which contains an oblong slot 31 by which a screw 33 passes for easy adjustment, and mating with an integral catch 18, and forming the hook-up 20. Both the hook-up 20 on the cantilever 14 and the counter rail 22 have the same feature and the same purpose.

With the wall rail 12 anchored to the wall, the cantilever 14 is placed down onto the wall rail 12 and is snapped into place by way of the hook-up 20. Due to the tolerance between the wall rail 12 and the wall surface, once the hook-up 20 is completed there is no way for both the cantilever 14 and the counter rail 22 from coming loose or breaking away. If it becomes necessary to remove both the cantilever 14 and the counter rail 22, the screws 15 and 9 that pass through the holes 11 and 13 in the wall rail 12 would be loosened so that proper clearance is provided for the separation of the hook-up 20.

With the wall rail 12 on the wall, the cantilever 14 is ready to be put into place. As stated, supra, the cantilever 14 can be positioned anywhere along the wall rail 21 which allows for greater flexibility. The cantilever 14 supports the counter 36.

The drawer 25 is attached with two cantilevers 14 on opposite sides 28 and 30 of the drawer 25. Moving the location of the drawer 25 can readily be appreciated with the use of the present invention. The apron bracket 32 contains a first screw hole 48 and a second screw hole 50. A first screw 52 passes through the first screw hole 48 and a second screw 54 attaches the apron bracket 32 to the apron 60. The improved counter support 10 of the present invention resembles that of a large shelf support.

The counter 36 is supported entirely by the cantilever 14 which extends out from and attaches to the wall rail 12. The counter 36 itself attaches to the front and rear nailer plates 38 and 40, respectively, which are secured to the cantilever 14. The purpose of the counter rail 22 is to secure the rear of the counter 36 that runs along the wall.

Only after the locations of cabinets, drawers 25, etc., and the cantilevers 14 are in place, does the installer cut the counter rail 22 to the respective length and snaps it into place between the cantilevers 14.

It will be understood that each of the elements described above, or two or more together, may also find a useful application in other types of constructions differing from the type described above.

While the invention has been illustrated and described as embodied in an improved counter support, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A counter support fashioned to a vertical surface such as a wall, comprising:

a) a wall rail having a plurality of pairs of oblong throughbores and being attached to the wall by a plurality of pairs of said oblong throughbores, respectively, said oblong throughbores being 16" and 24" on center so that the holding power of the counter support is doubled and said plurality of pairs of said oblong throughbores line up with the wall studs, said wall rail having a hook-up means;

b) a cantilever positioned along said wall rail, said cantilever being placed down onto said wall rail and being snapped into place by said hook-up means so that additional flexibility is provided when said cantilever supports the counter;

c) a leveler disposed on said cantilever for leveling said cantilever;

d) a main attachment bracket containing an oblong slot;

e) a tab disposed on said main attachment bracket;

f) a screw passing through said oblong slot of said main attachment bracket and entering a front nailer plate so that adjustment of said counter is made simpler; and g) an integral catch mating with said tab and forming a hook-up.

2. A counter support as defined in claim 1;
further comprising a drawer rail bracket attached to said main attachment bracket.

3. A counter support as defined in claim 2;
further comprising a drawer being attached to said drawer rail bracket and to said cantilever on opposing sides of said drawer so that moving the location of said drawer can readily be accomplished.

4. A counter support as defined in claim 3;
further comprising back-side ribbing for making said wall rail more rigid.

5. A counter support as defined in claim 4;
further comprising a shelf formed in said wall rail for containing a leveler that adjustably connects said shelf to said cantilever and that said cantilever is prevented from having any forward or upward movement.

6. A counter support as defined in claim 5;
further comprising a rest block having the shape of a substantial cube and being positioned on said shelf and acting as a stopper and whose substantial cube shape keeps said rest block from spinning.

7. A counter support as defined in claim 6;
further comprising an adjustable apron bracket for front alignment of the counter, said adjustable apron bracket can move in and out.

8. A counter support as defined in claim 7;
further comprising said front and a rear nailer plate, said front and said rear nailer plate being secured to and extending from said cantilever, and said front and said rear nailer plates being attached to the counter.

9. A counter support as defined in claim 8;
further comprising a counter rail securing the rear of the counter anywhere along said wall rail.

10. A counter support as defined in claim 8;
further comprising an apron bracket, a nailer plate, said apron bracket mounting to front of said nailer plate so that said apron can be attached to lower part of said apron bracket.

11. A counter support as defined in claim 9;
further comprising a front nailer plate and a rear nailer plate, said counter is supported entirely by said cantilever which extends out from and attaches to said wall rail, said counter itself attaches to said front and said rear nailer plates, respectively, which are secured to said cantilever, said counter rail securing rear of said counter.

* * * * *